US007634969B2

(12) United States Patent
Neunzert et al.

(10) Patent No.: US 7,634,969 B2
(45) **Date of Patent: *Dec. 22, 2009**

(54) RETAINER FOR SECURING A TABLE IN A FOLDED POSITION

(75) Inventors: Martin Neunzert, Ogden, UT (US); Doug Fuller, Ogden, UT (US); Ray Adams, Clearfield, UT (US)

(73) Assignee: Lifetime Products, Inc., Clearfield, UT (US)

( * ) Notice: Subject to any disclaimer, the term of this patent is extended or adjusted under 35 U.S.C. 154(b) by 371 days.

This patent is subject to a terminal disclaimer.

(21) Appl. No.: 11/112,075

(22) Filed: Apr. 22, 2005

(65) Prior Publication Data

US 2005/0241550 A1 Nov. 3, 2005

Related U.S. Application Data

(63) Continuation-in-part of application No. 10/843,037, filed on May 10, 2004, and a continuation-in-part of application No. 29/219,894, filed on Dec. 22, 2004, now Pat. No. Des. 515,411, and a continuation-in-part of application No. 29/220,005, filed on Dec. 22, 2004, now abandoned, and a continuation-in-part of application No. 29/220,004, filed on Dec. 22, 2004, now abandoned.

(60) Provisional application No. 60/564,393, filed on Apr. 22, 2004.

(51) Int. Cl.
*A47B 3/00* (2006.01)

(52) U.S. Cl. ..... 108/132; 108/168; 108/172

(58) Field of Classification Search ..... 108/168, 108/172, 169, 173, 115, 34, 38, 35; 248/165, 248/166, 439, 150, 188.6
See application file for complete search history.

(56) References Cited

U.S. PATENT DOCUMENTS 429,458 A 6/1890 Kraemer (Continued)

FOREIGN PATENT DOCUMENTS

CN 2414667 Y 12/2000

OTHER PUBLICATIONS

U.S. Appl. No. 12/042,250, filed Mar. 4, 2008, Larcom.

(Continued)

*Primary Examiner*—José V Chen
(74) *Attorney, Agent, or Firm*—Workman Nydegger

(57) ABSTRACT

A table may include a table top with a first portion that is movable relative to a second portion between a folded position and an unfolded position. The table may also include a retainer that is sized and configured to retain the table in a folded position so that the table does not unintentionally unfold when the folded table is being carried, transported and/or stored. To help retain the table in a folded position, the retainer may include a first end that is connected to the first portion of the table top and a second end that is connected to the second portion of the table top. In particular, the retainer may be connected to portions of the table such as the lower portion of the table top, the frame, one or more connecting rods or support members, and the like.

20 Claims, 8 Drawing Sheets

U.S. PATENT DOCUMENTS 493,441 A 3/1893 Munz
643,511 A 2/1900 Lloyd
1,514,917 A 11/1924 Lotz
1,614,187 A 1/1927 Coggins
1,639,367 A 8/1927 Seward
1,765,766 A 6/1930 Lyon
1,907,111 A 5/1933 Holland et al.
1,976,140 A 10/1934 Paul
2,086,463 A 7/1937 Bram
2,542,394 A 2/1951 Cohen et al.
2,596,250 A 5/1952 Klinger
D167,944 S 10/1952 Kolenda et al.
2,619,394 A 11/1952 Mahr
2,715,558 A * 8/1955 Lander ..... 108/35
2,730,418 A 1/1956 Blink
2,739,860 A * 3/1956 Wilson ..... 108/169
2,747,957 A 5/1956 Lencioni
2,871,076 A 1/1959 Mell
2,872,259 A 2/1959 Thorpe
3,074,770 A * 1/1963 Joos ..... 108/35
3,076,865 A 2/1963 Volk
3,108,550 A * 10/1963 Knoblock ..... 108/124
D197,065 S 12/1963 Nilsson
3,143,982 A 8/1964 Blink et al.
3,174,796 A * 3/1965 Brown ..... 108/173
3,187,373 A 6/1965 Fisher
3,304,891 A 2/1967 Rachman
3,368,504 A 2/1968 Cohen
D212,123 S 8/1968 Foote
3,415,208 A 12/1968 Thoresen et al.
3,458,242 A * 7/1969 Williams ..... 312/258
D222,234 S 10/1971 Imber
3,656,439 A 4/1972 Domin
3,731,971 A 5/1973 Sjogren
3,823,938 A 7/1974 Unno
3,860,995 A 1/1975 Lautenschlager
3,866,913 A 2/1975 Zimmers et al.
3,954,068 A * 5/1976 Roberts et al. ..... 105/124
4,005,898 A 2/1977 Way
4,027,600 A 6/1977 Mueller
D247,080 S 1/1978 Robinson
4,089,522 A 5/1978 Rock
4,101,183 A * 7/1978 McManus ..... 108/124
4,112,855 A * 9/1978 Colby ..... 108/115
4,133,271 A 1/1979 Carlson
D253,079 S 10/1979 Hill
4,269,435 A 5/1981 Jarvenkyla
4,286,353 A 9/1981 Roche
4,371,202 A 2/1983 Freeman
4,392,437 A * 7/1983 Wallace ..... 108/172
4,489,661 A 12/1984 Fitzgerald
D281,949 S 12/1985 Hartmann
4,567,835 A 2/1986 Reese et al.
4,569,545 A 2/1986 Hartmann
4,653,804 A 3/1987 Yoo et al.
D291,728 S 9/1987 Hoyt
D297,811 S 9/1988 Payan
4,841,877 A 6/1989 Virtue
4,883,314 A 11/1989 Sakong
4,911,085 A 3/1990 Pencoske
D309,255 S 7/1990 Karow, Jr.
5,009,170 A * 4/1991 Spehar ..... 108/36
5,141,192 A 8/1992 Adams
5,154,441 A 10/1992 White et al.
5,251,359 A 10/1993 Finkl
5,357,872 A 10/1994 Wilmore
5,377,601 A 1/1995 Cashen
5,381,740 A 1/1995 Johnston
5,421,272 A * 6/1995 Wilmore ..... 108/115
5,501,157 A 3/1996 Westerburgen
D374,171 S 10/1996 Protz, Jr.
D378,439 S 3/1997 Gary
5,647,107 A 7/1997 Brewster
D392,175 S 3/1998 Beck
5,730,066 A 3/1998 Auten et al.
D402,396 S 12/1998 Protz, Jr.
5,857,650 A 1/1999 Lin
D407,624 S 4/1999 Ehrig
D414,626 S 10/1999 Collins et al.
D417,136 S 11/1999 Jackovin
5,983,807 A 11/1999 Tarnay et al.
6,000,345 A 12/1999 Gillotti
D420,527 S 2/2000 Pinch
6,032,585 A 3/2000 Pinch
6,058,853 A 5/2000 Pinch
D430,699 S * 9/2000 Coleman, Jr. ..... D26/138
6,112,674 A 9/2000 Stanford
6,238,045 B1 * 5/2001 Ono et al. ..... 347/96
D451,007 S 11/2001 Jones
6,334,400 B1 * 1/2002 Nien ..... 108/115
6,454,357 B1 9/2002 Foulger
D468,135 S 1/2003 Ashby et al.
D478,495 S 8/2003 Votruba et al.
D479,778 S 9/2003 Haney et al.
D481,927 S 11/2003 Wu
6,684,426 B1 2/2004 Lin et al.
6,708,532 B2 3/2004 Winland
D489,557 S 5/2004 Strong et al.
6,752,091 B2 * 6/2004 Glover et al. ..... 108/168
6,842,923 B1 1/2005 Castellani
6,848,731 B2 2/2005 Khubani
6,905,166 B2 6/2005 Zhurong et al.
6,916,093 B2 7/2005 Quehin
D515,411 S * 2/2006 Kearl ..... D8/395
7,063,025 B2 6/2006 Ashby et al.
7,069,865 B2 * 7/2006 Strong et al. ..... 108/132
7,096,799 B2 8/2006 Strong et al.
7,111,563 B2 9/2006 Strong
7,143,702 B2 12/2006 Stanford
7,150,237 B2 12/2006 Lin et al.
7,171,910 B2 2/2007 Neunzert et al.
7,178,471 B2 2/2007 Strong et al.
7,278,361 B2 10/2007 Zhurong et al.
7,299,753 B2 11/2007 Strong
7,461,601 B2 12/2008 Jin et al.
7,475,644 B2 1/2009 Strong et al.
2004/0094076 A1 5/2004 Jin
2005/0005826 A1 1/2005 Strong
2005/0155534 A1 * 7/2005 Lin et al. ..... 108/132
2005/0241550 A1 11/2005 Neunzert
2005/0241551 A1 11/2005 Neunzert

OTHER PUBLICATIONS

U.S. Appl. No. 29/220,004, filed Dec. 22, 2004.
U.S. Appl. No. 29/220,005, filed Dec. 22, 2004.
Notice of Allowance dated Jun. 29, 2005 cited in United States Patent No. D515,411.
Notice of Allowance dated Nov. 28, 2005 cited in U.S. Appl. No. 29/220,004.
Notice of Allowance dated Nov. 28, 2005 cited in U.S. Appl. No. 29/220,005.
Notice of Allowance dated Nov. 17, 2008 cited in U.S. Appl. No. 11/112,810.
Office Action dated Apr. 24, 2008 cited in U.S. Appl. No. 11/112,810.
Office Action dated Nov. 23, 2007 cited in U.S. Appl. No. 11/112,810.
Office Action dated Mar. 15, 2007 cited in U.S. Appl. No. 11/112,810.
U.S. Appl. No. 29/219,893, filed Dec. 2004, Jin.
U.S. Appl. No. 29/230,220, filed May 2005, Strong.
Office Action dated Oct. 13, 2005 cited in U.S. Appl. No. 10/408,914.
Office Action dated Aug. 4, 2006 cited in U.S. Appl. No. 29/230,220.
Office Action dated Jun. 5, 2007 cited in U.S. Appl. No. 11/510,916.

Office Action dated Mar. 28, 2008 cited in U.S. Appl. No. 10/843,037.
Office Action dated Jan. 5, 2009 cited in U.S. Appl. No. 10/843,037.
Notice of Allowance dated Jan. 10, 2006 cited in U.S. Appl. No. 29/219,893.
Notice of Allowance dated May 1, 2006 cited in U.S. Appl. No. 10/408,914.
Notice of Allowance dated Oct. 10, 2006 cited in U.S. Appl. No. 29/219,893.
Notice of Allowance dated Apr. 5, 2007 cited in U.S. Appl. No. 29/230,220.
Notice of Allowance dated Sep. 15, 2008 cited in U.S. Appl. No. 11/510,916.

* cited by examiner

RETAINER FOR SECURING A TABLE IN A FOLDED POSITION

CROSS-REFERENCE TO RELATED APPLICATIONS

This application claims priority to and the benefit of U.S. provisional patent application Ser. No. 60/564,393, which was filed on Apr. 22, 2004, and entitled FOLD-IN-HALF TABLE. This application is also a continuation-in-part of U.S. utility patent application Ser. No. 10/843,037, which was filed on May 10, 2004, and entitled PORTABLE FOLDING TABLE WITH LOCKING HINGE. This application is also a continuation-in-part of application No. 29/219,894 filed Dec. 22, 2004, now U.S. design Pat. No. D515,411, and entitled CLIP. This application is also a continuation-in-part of U.S. design Pat. application 29/220,004, which was filed on Dec. 22, 2004, entitled CLIP, now abandoned. This application is also a continuation-in-part of U.S. design Pat. application 29/220,005, which was filed on Dec. 22, 2004, entitled CLIP, now abandoned. Each of these patents and applications is incorporated by reference in its entirety.

BACKGROUND OF THE INVENTION

1. Field of the Invention

The present invention generally relates to furniture and, in particular, to tables.

2. Description of Related Art

Many different types of tables are well known and used for a variety of different purposes. For example, conventional tables may include legs that are pivotally attached to a table top and the legs may be movable between a use position in which the legs extend outwardly from the table top and a storage position in which the legs are folded against the table top. Conventional tables with relatively large table tops and folding legs are often referred to as "banquet tables" and these tables are frequently used in assembly halls, banquet halls, convention centers, hotels, schools, churches and other locations where large groups of people meet. Because these conventional tables are generally easy to move and relatively portable, these types of tables can often be positioned in an assortment of different configurations and used in a variety of settings. When the tables are no longer needed, the table legs can be moved into the storage position and the tables may be moved or stored.

Conventional banquet tables with collapsible legs may allow the table to be more conveniently stored. The table top for many conventional banquet tables with collapsible legs, however, retains its size and shape. For example, many known banquet tables have a length between six to ten feet and a width between three to four feet. As a result, the storage of many conventional banquet tables, even with the legs in the collapsed position, may require a large storage area. This large storage area for each table may be problematic for large facilities such as hotels, schools and churches because a considerable number of these table may have to be stored. Thus, a big area may be required to store the tables. In addition, smaller facilities such as restaurants, offices and homes may use one or more conventional banquet tables. These smaller facilities may use the tables less frequently, such as during special occasions. Conventional banquet tables, even when the legs are folded, are often too bulky and obstructive to be conveniently used and stored at such smaller facilities. As a result, it is often necessary for both larger and smaller facilities to rent and/or borrow one or more banquet tables when needed. Disadvantageously, this process of renting and/or borrowing banquet tables can be inconvenient, time consuming and costly.

In addition, conventional banquet tables are often very difficult to move or transport from one location to another. For example, because of the length of many conventional banquet tables, the tables are often difficult to move by a single person. In addition, the extended length of the banquet tables may preclude the tables from being transported in the trunk or back seat of a typical passenger car. Accordingly, the banquet tables may have to be transported by a truck or trailer, which may be difficult to obtain, expensive and require a significant amount of time.

It is also known to construct tables that are capable of being folded-in-half. In particular, conventional fold-in-half tables typically include a table top with two sections that are pivotally connected by a hinge. The two sections of the table top may be moved between an unfolded position or use position in which the sections of the table top are generally aligned in the same plane and a folded position in which the two sections are positioned generally adjacent to each other for storage.

Disadvantageously, many known tables with foldable table tops are unstable and unable to support a significant amount of weight. For example, the connection of the two table top sections of many known fold-in-half tables may be relatively weak, which may allow, for example, a portion of the table top to sag. In order to construct a stronger table top, it is known to make foldable table tops out of stronger and thicker materials. Undesirably, this may increase the weight of the table top, which may make the table more difficult to carry and move.

Many conventional tables with foldable table tops also include hinges that connect the two portions of the table top and the hinges are often connected to the table top by a plurality of screws that are bored into the table top. Disadvantageously, the structural integrity of the table top may be decreased by the holes created by the plurality of screws, and this may allow the table to collapse and fail. In addition, because the screws are typically individually attached to the table top, this may significantly increase the amount of the time required to construct the table. Further, this may increase the manufacturing time and costs to make the table.

Additionally, known tables with foldable table tops are often difficult to transport and store because it may be hard to maintain the table top in the closed position, especially for a single person. In particular, the table tops of many known foldable tables can unintentionally swing between the folded and unfolded position while the tables are being moved, positioned and/or stacked. That is, while the table is being moved, the table top may inadvertently move from the folded to the unfolded position. If this occurs, the table may be undesirably dropped, and this may damage the table and/or injure the person carrying the table.

Further, when conventional fold-in-half tables are in the folded or storage position, it may be difficult to lift and move the table because it may be hard to grasp the table. In particular, the tables may be difficult to carry because there no convenient handholds or portions of the table to grab. In addition to many conventional fold-in-half tables being difficult to grasp and move in the folded position, this problem may be exasperated by the table top unintentionally unfolding while the table is being moved.

BRIEF SUMMARY OF THE INVENTION

A need therefore exists for a table that reduces or eliminates the above-described and other disadvantages and problems.

One aspect is a table that may include a table top and one or more legs or support pedestals that may be used to support the table top in a use or support position. The legs or support pedestals are preferably movable between an extended or use position and a collapsed or storage position relative to the table top. Advantageously, when the legs or support pedestals are in the use position, the table may be used to support a wide variety of objects and the table may be used for a variety of different purposes.

Another aspect is a table that may include a table top that is capable of being moved between a folded position and an unfolded position. Preferably, the table top includes two sections and the two sections are generally aligned in the same plane when the table top is in the unfolded position and the two sections are generally positioned adjacent to each other when the table top is in the folded position. The table may also include legs that are movable between a use position and a collapsed position. Advantageously, if the table includes both a foldable table top and foldable table legs that can be selectively moved between use and collapsed positions, then the table may be stored in a relatively compact area. This may allow, for example, a single person to easily move and transport the table. In addition, this may allow the table to be positioned in a relatively small area, such as the backseat or trunk of an automobile. Further, this may allow one or more tables to be shipped and/or stored in relatively small areas.

Yet another aspect is a table that may include a table top constructed from plastic and the plastic table top is preferably constructed using a blow-molding process. Advantageously, this may allow a lightweight table top to be easily constructed and it may allow the table top to be formed into various desired configurations, shapes, sizes and designs. This may also allow a table top to be constructed that is generally weather resistant and temperature insensitive, which may allow the table to be used in a wide variety of locations and environments. In addition, this may allow a table top that is durable, long-lasting and corrosion resistant to be constructed. Further, because a table top constructed from blow-molded plastic may be relatively strong, the table may be used to support a relatively large amount of weight. Significantly, a table top constructed from blow-molded plastic may also form a structural member of the table, but the table top may be supported by other structures, such as a frame.

Advantageously, a table top constructed from blow-molded plastic may be relatively strong because it includes opposing walls or surfaces that are separated by a distance. The opposing walls may help create a high-strength, rigid table top. In addition, because the interior portion of the table top may be generally hollow, that may create a lightweight table top. Thus, the blow-molded table top may be both lightweight and strong.

Still another aspect is a table that may include a table top that includes two sections. For example, the table top may include a first table top section and a second table top section, and each section may include an inner edge or portion. Desirably, the inner edges or portions of the first and second table top sections engage or contact when the table top is in the extended or use position, and the inner edges or portions are spaced apart from each other in the folded position. Advantageously, the inner edges or portions may be sized and configured to engage and/or overlap to allow, for example, a secure connection of the first and second sections when the table top is in the extended or use position. For instance, the inner edges or portions of the table top sections may include one or more projections and/or recesses that are sized and configured to contact or engage when the table top is in the extended or use position. In particular, the inner edges or portions may include tongue and groove portions which matingly engage when the table top is in the extended or use position. That is, the inner edge or portion of the first table top section may have one or more tongue and/or groove portions that are aligned with corresponding tongue and/or groove portions in the inner edge or portion of the second table top section. The table top sections are preferably configured so that the tongue and groove portions interlock when the table top is in the extended or use position. Advantageously, this may increase the strength and rigidity of the table top, which may allow the table top to be constructed of a lighter and/or thinner material without sacrificing strength or integrity.

A further aspect is a table that may include two sections that are movable between a folded and unfolded position, and the table may include a handle. Advantageously, this handle may allow the table to be more easily transported or moved. For example, the handle can be mounted to a portion of the table top such that the handle may project between the edges of the table top sections when the table top is in the folded position. In this configuration, a single individual may easily gasp the projecting handle to carry the table. The table may also include a handle retention assembly that may be used to secure the handle in a desired position. In particular, the handle retention assembly may advantageously secure the handle in a generally fixed position. For instance, the handle retention assembly may secure the handle in a generally fixed position that is out of the way and not obstructive when the table top is in the unfolded position.

Another aspect is that the table may be easily assembled and/or disassembled. For example, the table may not include any heavy or complex mechanisms to attach the table legs to the table top and/or to connect the first and second sections of the table top. In particular, the table may include a frame that quickly and easily attaches the legs to the table top. For instance, the frame may include two elongated side rails and the side rails may be connected to one or more frame mounting portions. Advantageously, the frame mounting portions may be integrally formed in the table top and the frame can be attached to the table top by a snap, friction or interference fit. Significantly, this may allow the frame to be attached to the table top without mechanical fasteners such as screws or bolts, but mechanical fasteners may be used if desired. Because mechanical fasteners are not required to attach the frame to the table top, fewer parts may be required to assemble the table and holes do not have to be formed in the table top. This may also allow the table to be quickly and easily manufactured and assembled. Further, fewer workers may be required to assemble the table and the relatively straight forward design and attachment of the frame to the table top may allow the table to be shipped either assembled or unassembled, which may allow retailers or consumers to assemble the table if desired.

Still another aspect is a table that may include a table top with sections that are interconnected. For example, a frame may be attached to the sections of the table top and the frame may be sized and configured to allow the table top to be moved between the folded and unfolded positions. In particular, the frame may include side rails that are connected to the sections of the table top and one or more hinge assemblies may be connected to the side rails. The hinge assemblies may enable the table top to move between the folded and unfolded positions. Preferably, the hinge assemblies are mounted directly to the frame and the hinge assemblies are not connected to the table top. Because mechanical fasteners are not required to attach the hinge assemblies to the table top, fewer parts may be required to assemble the table and holes do not have to be formed in the table top, which may allow the table to be quickly and easily manufactured and assembled. Because the hinge assemblies do not have to be separately mounted directly to the table top by screws or other fasteners, this may allow retailers or consumers to assemble the table if desired.

Still yet another aspect is a table that may include a table top with sections that are interconnected by one or more hinge assemblies to allow the table top to be moved between folded and unfolded positions. The table preferably includes a mechanism, such as a bolt, that is slidable or movable relative to the table top between a first position and a second position. For example, when the table top is in the unfolded position, the bolt may be sized and configured to lock a hinge assembly and/or a portion of the frame in a generally fixed position to secure the table top in the unfolded position. The bolt may also be moved to unlock the hinge assembly and/or the frame to allow the table top to be moved into the folded position. Advantageously, the bolt may secure the table top in the unfolded position and prevent the table from unintentionally folding.

A further aspect is a table that may include one or more legs that are movable between an extended position and a collapsed position relative to the table top. The legs may be connected to a cross member and the cross member may be connected to the frame.

A still further aspect is a table that may include a retainer which may be connected to a first portion of the table top. Advantageously, the retainer may be sized and configured to secure the table top in a closed or folded position. For example, the retainer may include a first end that is connected to a first portion of the table top, such as a cross member or a portion of the frame. The second end of the retainer may be sized and configured to be attached to a second portion of the table top when the table top is in the closed or folded position. In particular, the second end of the retainer may be connected to a cross member or a portion of the frame. Preferably, the second end of the retainer is selectively connected to the second portion of the table top to allow the table top to be folded and unfolded. Significantly, the retainer may help retain the table top in the folded position so that the table top does not unintentionally unfold when the folded table is being carried, transported and/or stored. The retainer may also be sized and configured to automatically engage the second portion of the table top, which may simplify the engagement process. In addition, the retainer may be selectively connected to the first portion of the table top, which may simply the manufacturing process and allow the retainer to be quickly and easily attached.

Yet still another aspect is a table that may include a brace that is connected to one or more of the legs. In particular, the brace may include a first end that is connected to the table top and a second end that is connected to the leg. The brace is preferably sized and configured to support the leg in an extended position relative to the table top. The brace, which may be any suitable type of brace such as a slotted brace, may be biased to secure the leg in the extended position. For example, the brace may include a pin that is disposed within a slot and the brace may include a biasing member, such as a spacer or washer. The biasing member may be constructed from a deformable and resilient material, such as rubber, which may be used to bias the brace into a desired position. For example, the brace may be biased to lock the brace in a generally fixed position, which may secure the leg in the extended position.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the invention. It will be appreciated that the drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is generally directed towards a table that includes a table top that are capable of being folded in half. The principles of the present invention, however, are not limited to a table with a table top that is capable of being folded in half. It will be understood that, in light of the present disclosure, the tables and various portions of the tables disclosed herein can be successfully used in connection with other types of furniture and structures.

Additionally, to assist in the description of the tables, words such as top, bottom, front, rear, right and left are used to describe the accompanying figures. It will be appreciated, however, that the tables can be located in a variety of desired positions and the tables can have various suitable shapes, sizes and configurations. A detailed description of exemplary embodiments of the table now follows.

Figure 1:
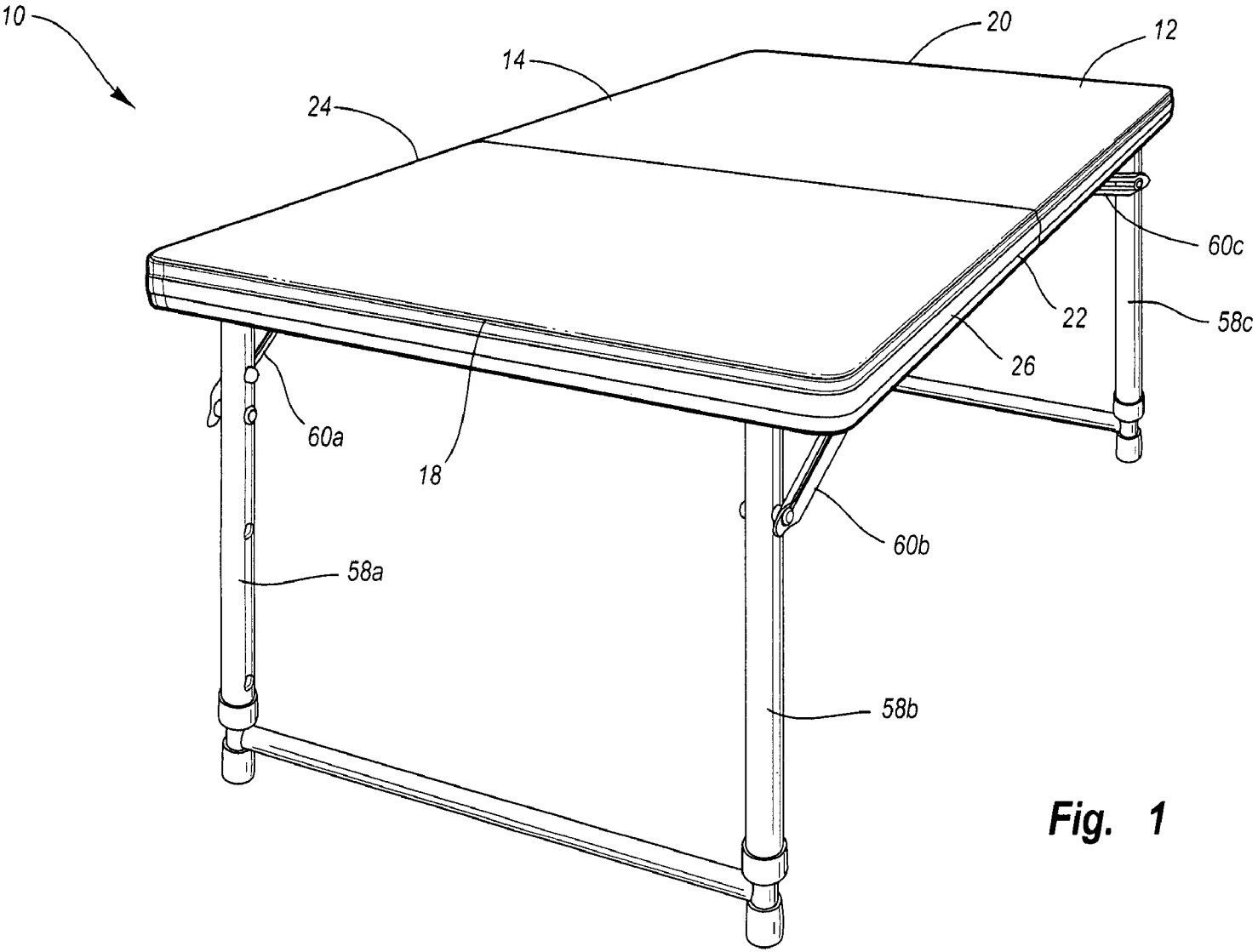
FIG. 1 is an upper perspective view of a table in accordance with an exemplary embodiment of the present invention, illustrating the legs in an extended position.
Figure 2:
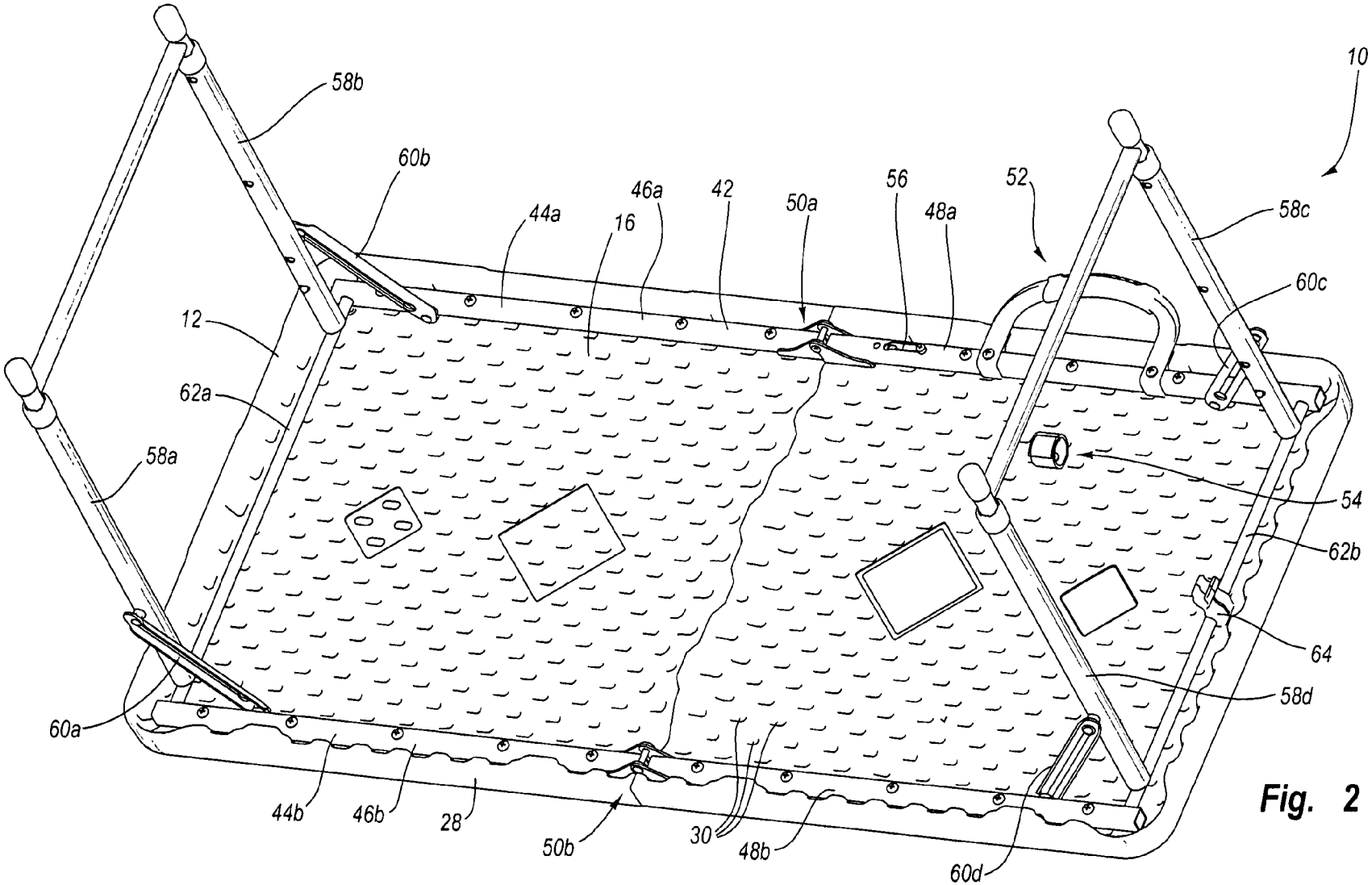
FIG. 2 is a lower perspective view of table shown in FIG. 1, illustrating the legs in an extended position.

As shown in FIGS. 1 and 2, an exemplary embodiment of a table 10 includes a table top 12 with an upper surface 14, a lower surface 16, a first end 18, a second end 20, a front side 22 and a rear side 24. The upper surface 14 of the table top 12 is preferably generally planar to create a relatively smooth and flat working surface, but the upper surface could also be textured and have other suitable shapes and configurations depending, for example, upon the intended use of the table 10. The table top 12 may also include an outer edge 26 that is disposed about a perimeter or periphery of the table top. All or a portion of the outer edge 26 of the table top 12 may be beveled, sloped, rounded and the like according to, for example, the intended design and/or aesthetics of the table 10.

The table top 12 may also include a generally downwardly extending lip 28 that is disposed near or at the outer edge 26 of the table top. The lip 28 preferably extends downwardly beyond the lower surface 16 of the table top 12 and the lip may be aligned with and/or form a part of the outer edge 26 of the table top. It will be appreciated that all or a portion of the lip 28 may also be spaced inwardly from the outer edge 26 of the table top 12. As discussed below, the lip 28 may be integrally formed with the table top 12 as part of a unitary, one-piece structure. The lip 28, however, does not have to be integrally formed as part of the table top 12 and the table 10 does not require the lip 28.

As shown in the accompanying figures, the table top 12 preferably has a generally rectangular configuration with rounded corners and slightly rounded edges 26. Desirably, the table top 12 has a relatively large size and it may be configured for use as a banquet, conference or utility table. In particular, the table top 12 may have a length of about five feet (about 1.5 meters) and a width of about two and one-half feet (about 0.75 meters). One of ordinary skill in the art will appreciate that the table top 12 can be larger or smaller according, for example, to the intended use of the table 10. Additionally, the table top 12 may have other suitable shapes and configurations such as square, circular, oval and the like depending, for example, upon the intended use of the table 10. In addition, the corners and edges 26 of the table top 12 do not have to be rounded and, in contrast, the corners and edges could have any desirable configuration. Further, the table top 12 could be sized and configured for use with other types of tables such as card tables, personal-sized tables, and the like.

The table top 12 is preferably constructed from a lightweight material and, more preferably, the table top is constructed from plastic, such as high density polyethylene. The plastic table top 12 is desirably formed by a blow-molding process because, for example, it may allow a strong, lightweight, rigid and sturdy table top to be quickly and easily manufactured. Advantageously, the blow-molded plastic table top 12 may be lightweight because it may include a hollow interior portion that is formed during the blow-molding process. It will be appreciated, however, that the table top 12 does not have to be formed with a hollow interior portion and the hollow interior portion can be filled, for example, with a material such as foam after the table top is formed.

The table top 12 is preferably constructed from blow-molded plastic because blow-molded plastic table tops are relatively durable, weather resistant, temperature insensitive, corrosion resistant, rust resistant and blow-molded plastic generally does not deteriorate over time. One of ordinary skill in the art, however, will appreciate that the table top 12 does not have to be constructed from blow-molded plastic and other suitable materials can be used to construct the table top such as other types of plastics, polymers and synthetic materials. In addition, the table top 12 may be constructed from other materials with desirable characteristics such as wood, metal, fiberglass, ceramics, graphite and the like. Further, other types of processes may be used to construct the table top 12 such as injection molding, rotary molding and the like.

The upper surface 14 of the table top 12 is preferably generally spaced apart from the lower surface 16 by a given distance and these two spaced apart surfaces may help create a rigid and strong table top. Preferably, the upper surface 14 and the lower surface 16 of the table top 12 are separated by a generally constant distance so that the surfaces are generally aligned in parallel planes. The upper surface 14 and the lower surface 16, however, do not have to be spaced apart by a generally constant distance and, in fact, the upper and lower surfaces could be separated by any desired distance.

The table top 12 may also include one or more structures or features that may be sized and configured, for example, to increase the strength and rigidity of the table top. In particular, the table top 12 may include one or more depressions 30, which are also known as tack-offs or kiss-offs, that are sized and configured to increase the strength and rigidity of the table top. Advantageously, the depressions 30 and/or other reinforcement structures may be integrally formed as part of a unitary one-piece table top 12, such as during the blow-molding or other molding processes, but the depressions and other structures can also be formed independently and/or attached separately of the table top.

As shown in FIG. 2, the depressions 30 are preferably located in the lower surface 16 of table top 12 and the depressions are preferably sized and configured to increase the strength and structural integrity of the table top 12. The depressions 30 preferably extend towards the upper surface 14 of the table top 12 and the ends of the depressions 30 may contact or engage the inner portion of the upper surface of the table top. On the other hand, the ends of the depressions 30 may be spaced part from the inner portion of the upper surface 14 of the table top 12.

The depressions 30 preferably cover substantially the entire lower surface 16 of the table top 12, but it will be appreciated that the depressions may cover only a portion of the table top. Additionally, while the depressions 30 are shown and described as being located in the lower surface 16 of the table top 12, it will be appreciated that the depressions could be formed in any desired portion of the table top. For example, it will be appreciated that one or more depressions 30 may be formed in the upper surface 14 of the table top 12 and one or more depressions may be formed in the lower surface 16 of the table top 12, and these opposing depressions may be generally aligned. At least a portion of these opposing depressions 30 may contact or engage each other, but the opposing depressions do not have to touch or engage.

The depressions 30 are preferably also arranged into a predetermined pattern or array in order to increase the strength and structural integrity of the table top 12. In particular, the depressions 30 are preferably spaced closely together in a predetermined pattern such that the distance between the depressions is minimized. For example, minimizing the distance between the depressions 30 formed in the lower surface 16 of the table top 12 may diminish the unsupported areas of the upper surface 14 of the table top, which may increase the smoothness of the upper surface of the table top. In addition, minimizing the distance between the depressions 30 may increase the structural integrity and strength of the table top 12. Thus, the depressions 30 may be desirably closely spaced on the lower surface 16 of the table top 12 such that the depressions are separated by a minimum distance in order to create a table top with greater strength, improved structural integrity and an upper surface 14 with increased smoothness.

In addition, the depressions 30 are preferably arranged in a predetermined pattern with a generally constant and uniform spacing so that the table top 12 has generally uniform characteristics. In particular, the depressions 30 are preferably arranged into a generally uniform pattern across at least a majority of the lower surface 16 of the table top 12 so that the strength, structural integrity and/or other characteristics of the table top are generally uniform throughout the table top. Thus, the table top 12 has fewer, if any, weak or unsupported portions which may decrease the strength and structural integrity of the table top. Thus, the depressions 30 may be used to create a table top 12 with generally uniform characteristics. It will be appreciated that the depressions 30 may also have a non-uniform spacing depending, for example, upon various features that are formed in the table top 12 or upon the intended use of the table 10. It may be desirable, however, for these various features that are formed in the table top 12 to be sized and configured such that they do not significantly disturb or disrupt the generally uniform pattern of depressions 30.

Advantageously, the increased structural integrity and strength of the table top 12 may allow the outer wall thickness of the table top to be decreased, which may allow the table top to be constructed with less material. For example, if the table top 12 is constructed from blow-molded plastic and the outer wall thickness is reduced, then less plastic may be used to construct the table-top. Because less plastic may be used to construct the table top 12, that may allow the cost of the table 10 to be decreased. In addition, the table top 12 may cool more quickly during the manufacturing process because of the decreased outer wall thickness. This may allow the table top 12 to be removed from the manufacturing mold more quickly and it may allow the table top to, be removed at a higher temperature because the thinner outer wall may dissipate heat more rapidly. Significantly, because the cycle time required to construct the table top 12 may be decreased, the manufacturing efficiency may be increased.

Additional details regarding the size, shape and configuration of one or more depressions that may suitable for use in connection with the table top 12 are disclosed in Assignee's U.S. Pat. No. 7,069,865, which is incorporated by reference in its entirety. While the table top 12 preferably includes one or more depressions, it will be appreciated that the table top does not require any depressions or other reinforcing structures.

As discussed above and as shown in FIG. 2, the lip 28 is preferably disposed about the outer periphery of the table top 12 and it is generally aligned with the outer edge 26. The lip 28 may include an inner portion, and outer portion and a lower surface. Preferably, the outer portion of the lip 28 is generally aligned with the outer edge 26, but the lip could also be spaced inwardly from the outer edge of the table top. The lip 28 may also include a hollow interior and the lip may be integrally formed during the blow-molding process as part of table top 12. It will be appreciated, however, that the lip 28 does not have to be formed as a unitary component of the table top 12 and the table top does not require the lip.

The lower surface of the lip 28 is preferably sized and configured to facilitate stacking of the table 10. For example, the lower surface of the lip 28 may have a generally smooth, planar configuration to facilitate stacking of the table 10. In addition, the inner portion of the lip 28 may include a number of serrations, notches, ribs, struts and the like that are sized and configured to increase the strength, rigidity and/or flexibility of the lip 28. In particular, the inner portion of the lip 28 may include a number of notches, indentations, grooves or other inwardly extending portions to form at least a portion of an uneven or saw-tooth type surface. The inner portion of the lip 28 may also include a number of bumps, humps, protrusions or other outwardly extending portions to form at least a portion of an uneven or saw-tooth type surface. The inner portion of the lip 28 may also contain a combination of inwardly and outwardly portions to form at least a portion of the uneven or saw-tooth type surface. Other suitable configurations of the lip 28 and other portion of the table 12 are disclosed in Assignee's U.S. Pat. No. 7,111,563 and Assignee's pending U.S. patent application Ser. No. 11/051,933, which was filed on Feb. 4, 2005, entitled EDGE AND CORNER FOR A STRUCTURE CONSTRUCTED FROM BLOW-MOLDED PLASTIC; each of which are incorporated by references in their entirety.

It will also be understood that other features of the table top 12 may also be integrally formed with table top 12 as part of a unitary, one-piece structure. For example, various mounting portions, receiving portions and the like may be integrally formed as part of the table top 12. Because these features may be integrally formed as part of the table top 12, that may expedite the manufacturing process. These features, however, do not have to be integrally formed in the table top 12 and they could be attached to the table top by any suitable methods or devices.

Figure 3:
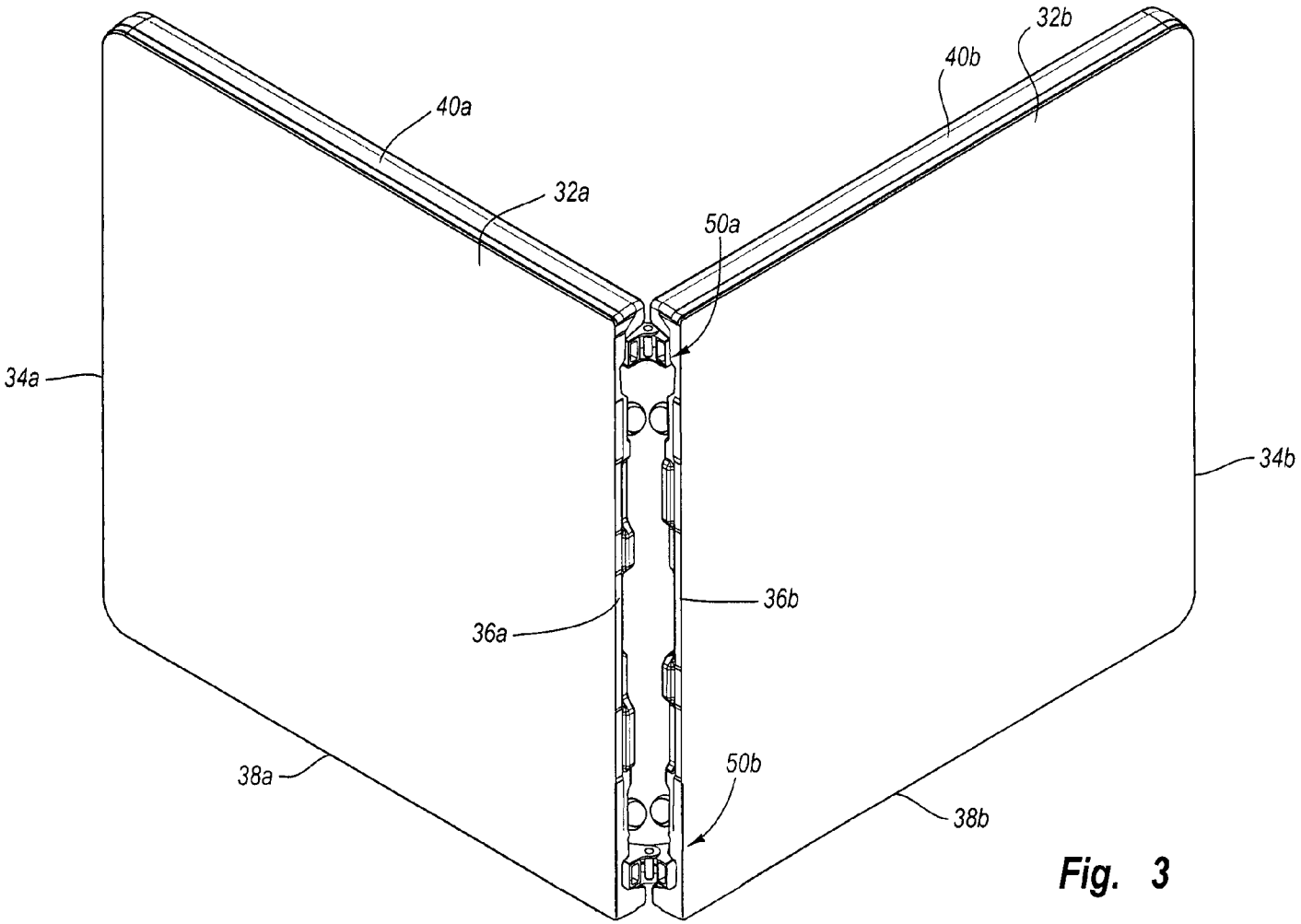
FIG. 3 is another perspective view of the table shown in FIG. 1, illustrating the table top in a partially folded position and the legs in a collapsed or folded position.
Figure 4:
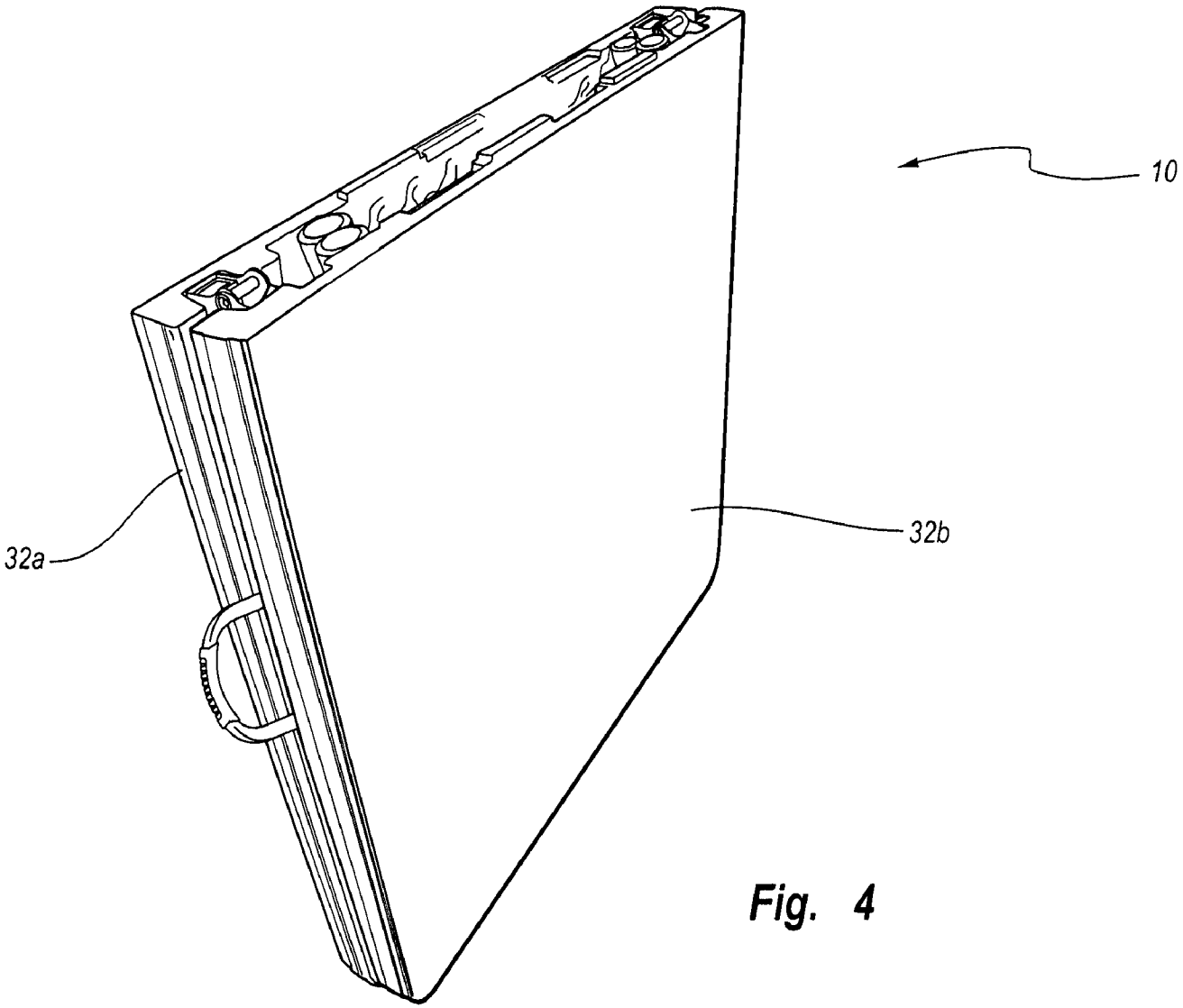
FIG. 4 is still another perspective view of the table shown in FIG. 1, illustrating the table top is a fully folded position and the legs in the collapsed or folded position.

As seen in FIG. 3, the table top 12 may include one or more table top sections 32, such as a first table top section 32*a* and a second table top section 32*b*. The table top sections 32*a*, 32*b* may include outer edges 34*a*, 34*b*; inner edges 36*a*, 36*b*; and opposing side edges 38*a*, 38*b* and 40*a*, 40*b* respectively. It will be appreciated that the table top 12 can include any suitable number of sections 32 and the table top 12 may also be constructed as a single, one-piece structure. Advantageously, the first table top section 32*a* and the second table top section 32*b* may be moved between a folded position as shown in FIG. 4 and an unfolded position as shown in FIG. 1. When the table top 12 is in the folded position, the table 10 may be more easily transported and/or stored.

The inner edges 36*a*, 36*b* of the table top sections 32*a*, 32*b* preferably contact, abut and/or are positioned adjacent to each other when the table top 12 is in the folded position. Significantly, the inner edges 36*a*, 36*b* of the table top sections 32*a*, 32*b* may be sized and configured to increase the strength and/or rigidity of the table top 12. In particular, the inner edges 36*a*, 36*b* of the table top sections 32*a*, 32*b* may include one or more portions that overlap, interlock and/or engage to increase the strength and/or rigidity of the table top 12. In greater detail, the inner edges 36*a*, 36*b* may include corresponding inwardly and outwardly extending portions that are sized and configured to contact, interlock and/or engage with the table top 12 is in the folded position. For example, as shown in FIG. 3, the inner edges 36*a*, 36*b* may each include an upper portion and a lower portion. The upper portions of the inner edges 36*a*, 36*b* may include generally planar surface that are sized and configured to abut and/or be positioned adjacent to each other when the table top 12 is in the unfolded position. The lower portions of the inner edges 36*a*, 36*b* may include one or more receiving portions, such as grooves or recesses, and one or more outwardly extending portions, such as extensions or flanges. The outwardly extending portions are preferably sized and configured to be at least partially received in the receiving portions when the table is in the unfolded position.

When the table 10 is being moved from the folded position to the unfolded position, the outwardly extending portions may be disposed in the receiving portions to, for example, interlock the table top sections 32*a*, 32*b*. This interlocking of the table top sections 32*a*, 32*b* may increase the strength and/or rigidity of the portion of the table top 12 along the inner edges 36*a*, 36*b*. Advantageously, this may help create a table top 12 with a smoother upper surface 14 and it may help prevent unwanted bending of the table top along the inner edges 36*a*, 36*b*. It will be appreciated that the outwardly extending portions and the receiving portions can have a variety of different sizes, shapes and configurations. It will also be appreciated that the table top 12 does not require outwardly extending portions and/or the receiving portions.

As best seen in FIG. 2, the table 10 may include a frame 42 and the frame may be sized and configured to increase the strength and/or rigidity of the table top 12, but the frame is not required. As discussed below, the frame 42 may also be used to attach the legs to the table top 12. As shown in the accompanying figures, the frame 42 may be connected to the lower surface 16 of the table top 12 and the frame may include two side rails 44*a*, 44*b* that are disposed proximate the outer edges of the table top. The side rails 44*a*, 44*b* preferably extend along all or at least a substantial portion of the length of the table top 12, but the side rails could have any suitable length and configuration. For example, while the side rails 44*a*, 44*b* are preferably disposed proximate the lip 28, the side rails may be disposed in any suitable location. It will be appreciated that while the frame 42 preferably includes side rails 44*a*, 44*b*, the frame could have other suitable configurations and arrangements, and the table 10 does not require a frame.

The frame 42 is desirably constructed from metal, which may easily be formed into the desired configuration by known operations, such as stamping and bending, and the metal may be coated or painted as desired. The frame 42 may be connected to the table top 12 be one or more fasteners, such as bolts or screws. The frame 42 may also be attached to the table top 12 without mechanical fasteners, such as disclosed in Assignee's U.S. Pat. No. 7,178,471, which is incorporated by reference in its entirety.

As best seen in FIG. 2, the side rails 44*a*, 44*b* of the frame 42 are preferably connected to the first and second table top sections 32*a*, 32*b* of the table top 12. For example, the side rails 44*a*, 44*a* may include first portions 46*a*, 46*b* that are connected to the first table top section 32*a*, and second portions 48*a*, 48*b* that are connected to the second table top section 32*b*.

The first and second table top sections 32*a*, 32*b* are preferably pivotally connected to allow the table top 12 to be moved between the folded and unfolded positions. For example, one or more hinge assemblies may be used to pivotally connect the first and second table top sections 32*a*, 342*b*. In particular, as shown in the accompanying drawings, a first hinge assembly 50*a* may be connected to the first side rail 44*a* and a second hinge assembly 50*b* may be connected to the second side rail 44*b*. The hinge assemblies 50*a*, 50*b* may include a first portion that is connected to the first portions 46*a*, 46*b* of the side rails 44*a*, 44*b* and a second portion that is connected to the second portions 48*a*, 48*b* of the side rails. The hinge assemblies 50*a*, 50*b* may include a hinge member, such as a pin, bolt, rod or the like, that allows the hinge assemblies to pivot about an axis. The hinge assemblies 50*a*, 50*b* are preferably connected to the side rails 44*a*, 44*b* by welding, adhesives, mechanical fasteners and the like. It will be appreciated that the hinge assemblies 50*a*, 50*b* can also be at least partially integrally formed as part of the frame 42. In addition, it will be appreciated that the hinge assemblies 50*a*, 50*b* can be connected to any suitable portions of the table 10 and the hinge assemblies can have any suitable arrangement and configuration that allows the first and second table top sections 32*a*, 32 to be selectively moved between the folded and unfolded positions.

The table 10 may include a handle 52 that may be sized and configured to facilitate lifting and moving the table. For example, as shown in FIG. 2, the handle 52 may be mounted to a portion of the table top 12 and the handle may project between the edges of the table top sections 32*a*, 32*b* when the table top is in the folded position (as shown in FIG. 4). In this configuration, a single individual can easily gasp the projecting handle 52 to carry the table 10. The table 10 may also include a handle retention assembly 54 that may advantageously secure the handle 52 in a generally fixed position. Desirably, the handle retention assembly 54 secures the handle 52 in an out of the way location, such as to the lower surface 16 of the table top, when the table 10 is in the unfolded position. Other suitable configurations of the handle 52 and/or the handle retention assembly 54 are disclosed in Assignee's pending U.S. patent application Ser. No. 11/112,900, which was filed on Apr. 22, 2005, entitled HANDLE FOR A PORTABLE TABLE, which is incorporated by reference in its entirety.

Figure 5A:
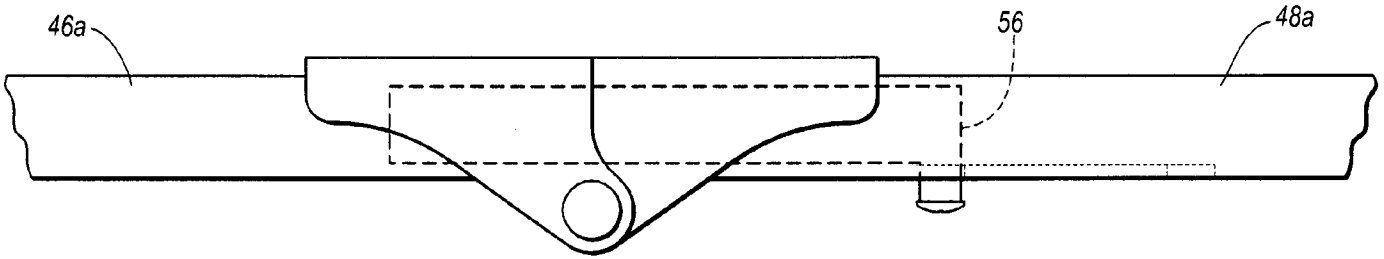
FIG. 5A is a side view of a portion of the table shown in FIG. 1, illustrating an exemplary portion of the table frame, hinge assembly and locking mechanism in a locked position.
Figure 5B:
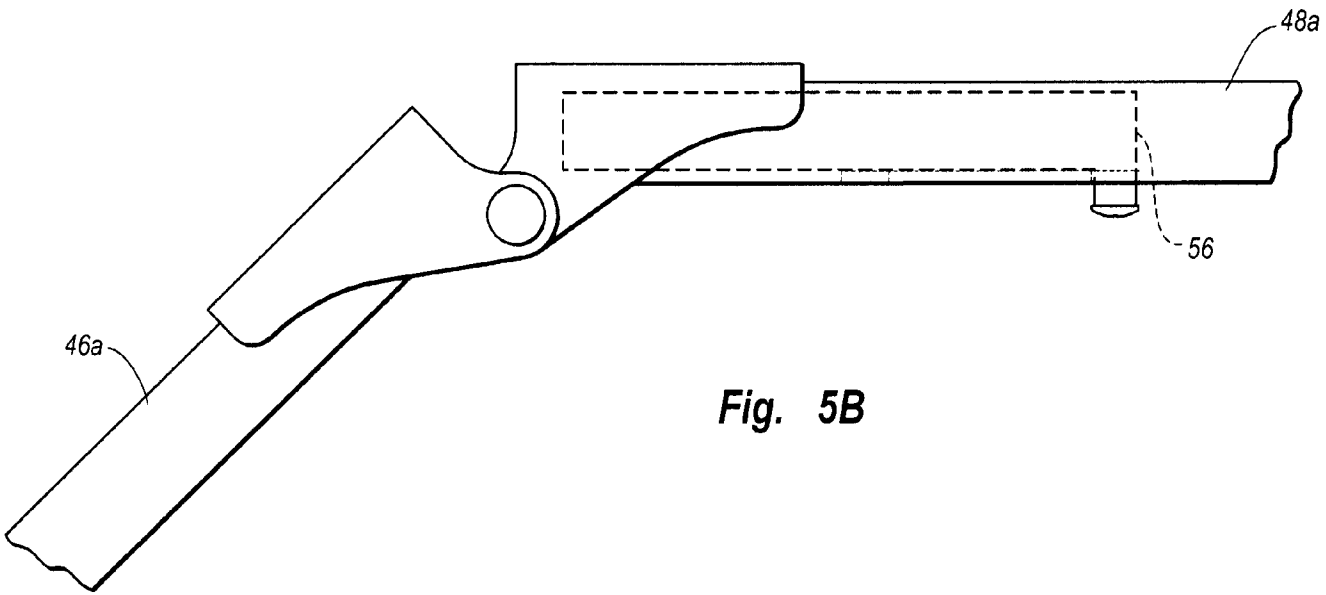
FIG. 5B is another side view of the portion of the table shown in FIG. 5A, illustrating the portion of the table frame, hinge assembly and locking mechanism in an unlocked and partially folded position.

The table 10 may also include a locking mechanism that is sized and configured to lock the table in a desired position. For example, the locking mechanism may be used to secure the table top 12 in the unfolded position. In particular, as shown in FIG. 2, the locking mechanism may include a bolt 56 that is slidable or otherwise movable relative to the table top 12. The bolt 56, when the table top 12 is in the unfolded position, may be designed to selectively lock the hinge assembly 50 and/or the table frame 42 in a generally fixed position. Accordingly, the locking mechanism may lock the table top 12 in a secure and stable position, and the table 10 can be easily moved without the risk of the table 12 unintentionally folding. In greater detail, as shown in FIG. 5A, the bolt 56 may secure the side rail portions 46*a*, 48*a* in a generally fixed position. On the other hand, as shown in FIG. 5B, the bolt 56 may be moved to allow the side rail portions 46*a*, 48*a* to be freely moved. Other suitable embodiments for a locking mechanism that may be used to secure the table 10 in the unfolded position are disclosed in Assignee's pending U.S. patent application Ser. No. 11/112,810, which was filed on Apr. 22, 2005, entitled LOCKING MECHANISM FOR A FOLD-IN-HALF TABLE, which is incorporated by reference in its entirety.

As discussed above, the table 10 may include one or more legs 58 and the legs are preferably movable between an extended or use position and a collapsed or storage position relative to the table top 12. Preferably, the legs 58 are positioned adjacent or proximate the lower surface 16 of the table top 12 in the collapsed or storage position to facilitate stacking, storage and/or shipping of the table. In addition, the legs 58 are preferably positioned adjacent or proximate the lower surface 16 of the table top 12 to allow the table top 10 to be positioned in a folded position such that the first table top section 32*a* is positioned adjacent or proximate the second table top section 32*b*.

For example, as shown in FIG. 2, the table 10 may include four legs 58*a*, 58*b*, 58*c*, 58*d* and one or more of the legs may be interconnected. The legs 58*a*, 58*b*, 58*c*, 58*d* are preferably sized and configured to support the table top 12 above a surface such as a floor, and the legs may be adjustable in length. It will be appreciated, however, that the legs 58 could be independently connected to the table 10 and the legs do not have to be adjustable in length. It will also be appreciated that the legs 58*a*, 58*b*, 58*c*, 58*d* may be connected to the table top 12 in any suitable manner. For example, the legs 58*a*, 58*b*,

58*c*, 58*d* may be connected to connecting rods 62 and the connecting rods may be connected to the frame 42. In particular, the ends of the connecting rods 62 may be disposed within openings in the side rails 44 of the frame 42 to allow the legs 58*a*, 58*b*, 58*c*, 58*d* to be attached to the table top 12.

The connecting rods 62 and the legs 58 are desirably constructed from hollow metal tubes because the metal tubes are relatively lightweight and strong. The hollow metal tubes forming the connecting rods 62 and legs 58 may have a generally oval configuration to provide increased strength. Advantageously, the oval configuration may also be used to create a thinner profile for the legs 58, which may create a thinner profile for the table 10 when the legs 58 are in the collapsed position.

It will be appreciated that the legs 58 may be constructed from other materials with the suitable characteristics and the legs 58 may have other shapes and configurations depending, for example, upon the intended use of the table 10. For example, the legs 58 may include only a single elongated support member or multiple elongated support members, and the legs 58 may be constructed as a single component or multiple components that are connected together. It will further be appreciated that the legs 58 need not be in pivotal engagement with frame 42 or the table top 12 to be collapsible. For example, the legs 58 may be detachably connected to the table top 12 such that when it is desired to collapse the table 10 for storage, the legs 58 are detached from the table top 12. Other suitable arrangements and configurations for attaching the legs 58 to the table 10 are disclosed in Assignee's U.S. Pat. No. 7,100,518, which is incorporated by reference in its entirety.

As shown in FIGS. 1 and 2, one or more braces 60 may be used in connection with the legs 58. For example, a brace 60*a*, 60*b*, 60*c*, 60*d* may be attached to the legs 58*a*, 58*b*, 58*c*, 58*d*, respectively, and the braces may be used to secure the legs in the extended position. The braces 60 may be a slotted brace in which a pin is disposed within an elongated slot. The braces 60 may also include a biasing member, such as a spacer or washer, which is preferably constructed from a deformable and resilient material, such as rubber, which may be used to bias the brace into a desired position. For example, the biasing member may be used to bias the brace 60 into a locked position, which may be used to lock the leg 58 in the extended position. Other suitable types of braces and mechanisms that may be used in connection with the table 10 are disclosed in Assignee's pending U.S. patent application Ser. No. 11/112,236, which was filed on Apr. 22, 2005, entitled BRACE ASSEMBLY FOR A TABLE, now abandoned, which is incorporated by reference in its entirety.

As shown in FIG. 2, the table 10 may include a retainer 64 that may be sized and configured to secure the table in the folded position. For example, as shown in the accompanying figures, the retainer 64 may be connected to a first portion of the table 10, such as the first table top section 32*a*. In particular, the retainer 64 may be connected to a portion of the frame 42, such as the connecting rod 62*b*. The retainer 64 is preferably sized and configured to be connected to a second portion of the table 10, such as the second table top section 32*b*, when the table is in the folded position. In greater detail, the retainer 64 is preferably sized and configured to be connected to a portion of the frame 42, such as the connecting rod 62*a*, when the table top 12 is in the folded position.

Advantageously, the retainer 64 may retain the table 10 in the folded position so that the table does not unintentionally unfold when the folded table is being carried, transported and/or stored. In addition, the retainer 64 may be sized and configured to automatically engage the other portion of the table top 12 to simplify the engagement process. The retainer 64 may also be quickly and easily connected to the connecting rods 62*a* and/or 62*b*, which may simplify the manufacturing process and allow the retainer to be used in a wide variety of situations and environments. Additionally, the retainer 64 may be connected to suitable portions of the table top 12 to secure the retainer in a fixed position. Significantly, because the retainer 64 may be connected to the table top 12 and/or the connecting rods 62*a*, 62*b* by a snap, friction or interference fit, the retainer may be easy to use and mechanical fasteners may not be required. It will be appreciated, however, that the retainer 64 may be connected to the table 10 by mechanical fasteners, adhesives, and the like, and the retainer can be attached to any suitable portions of the table.

Desirably, one portion of the retainer 64 is securely connected to a first portion of the table top 12, such as the connecting rod 62*b*, so that the retainer is permanently connected or not easily removed from that portion of the table top. The other portion of the retainer 64 is preferably selectively connected to another portion of the table top 12, such as the connecting rod 62*a*, so that the retainer may be quickly and easily attached and detached. This may allow the retainer 64 to quickly and easily secure the table top 12 in the folded position, and allow the table top to be quickly and easily moved into the unfolded position. It will be appreciated that either or both portions of the retainer 64 may be selectively or permanently connected to suitable portions of the table top 12 depending, for example, upon the design and/or intended use of the table 10.

Figure 6C:
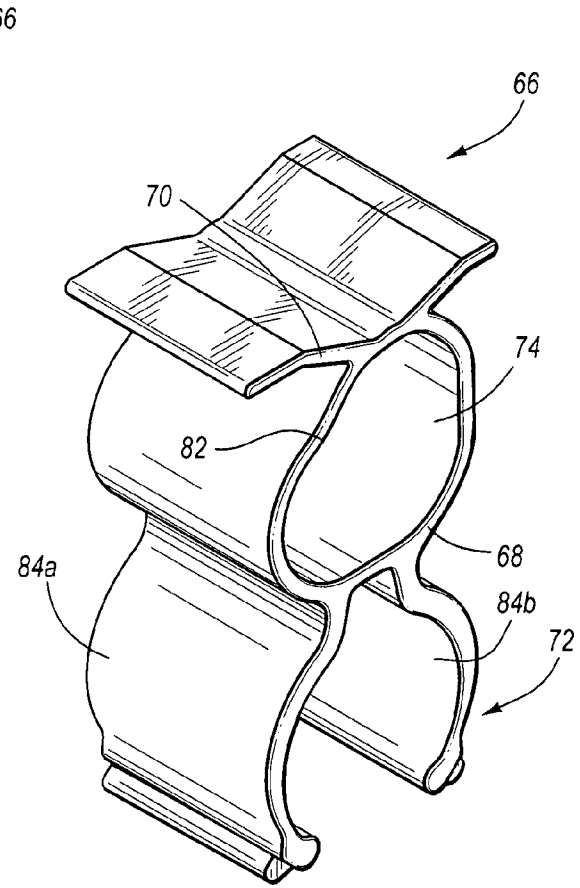
FIG. 6C is a perspective view of the retainer shown in FIG. 6A.
Figure 6B:
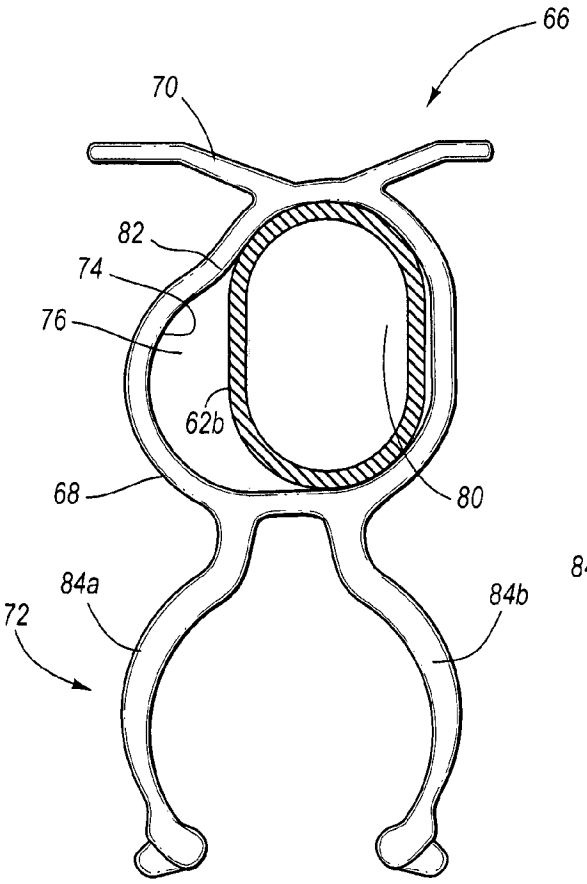
FIG. 6B is another side view of the retainer shown in FIG. 6A, illustrating the retainer connected to the cross member.
Figure 6A:
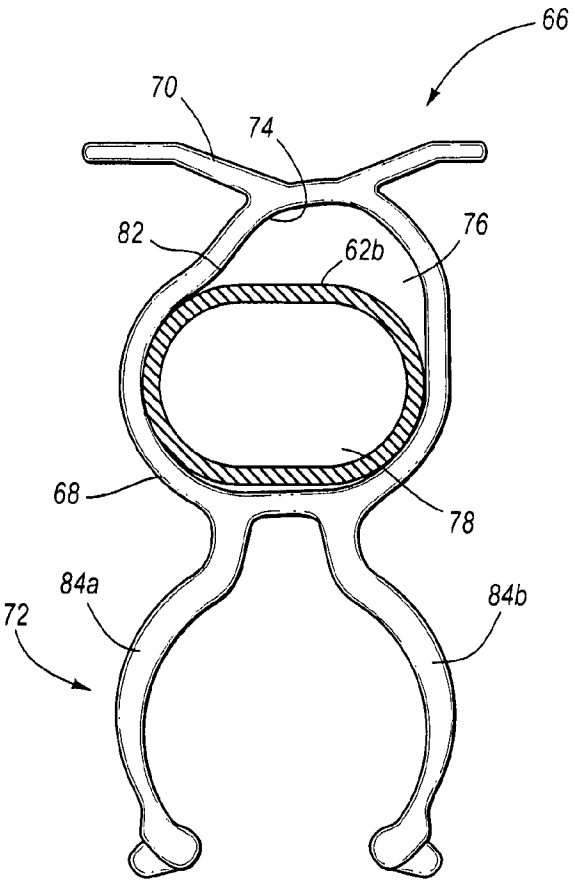
FIG. 6A is a side view of an exemplary retainer that may be used in connection with a table as shown in FIG. 1, illustrating the retainer connected to a cross member of the table.

An exemplary embodiment of a retainer that may be used to secure the table 10 in the folded position is shown in FIGS. 6A to 6C. The retainer 66 may include a tubular body 68 with a flange 70 mounted on one side and a clip 72 mounted on an opposing side. The tubular body 68 may include an interior surface 74 that bounds an opening 76 and the opening may be sized and configured to allow the retainer to be attached to a portion of the table, such as the connecting rod 62*b*. In particular, the connecting rod 62*b* may have a generally non-circular cross section and the connecting rod may be disposed through the opening 76. The opening 76 may be sized and configured to allow the connecting rod 62*b* to rotate within the opening, which may allow the retainer 66 to be easily connected to the connecting rod. In addition, the flange 70 may be sized and configured so that it is disposed adjacent to or against the lower surface 16 of the table top 12, which may help prevent the retainer 66 from inadvertently moving. The flange 70 may also be sized and configured such that forces tending to rotate the retainer 66 about the connecting rod 62*b* are countered by the flange contacting the lower surface 16 of the table top 12.

In greater detail, as shown in the accompanying figures, the opening 76 of the retainer 66 has a larger transverse cross section then the connecting rod 62*b*. The opening 76 is also non-symmetrical and configured to allow the connecting rod 62*b* to selectively rotate within the opening. More specifically, the opening 76 of the body 68 has a generally L-shaped configuration which includes a generally horizontal portion 78, as shown in FIG. 6A, and a generally vertical portion 80, as shown in FIG. 6B. Preferably, the channels 78 and 80 each have a transverse cross section that is substantially complementary to the transverse cross section of connecting rod 62*a*. In addition, an inside corner 82 of body 76 of the retainer 66 may partially separate the channels 78 and 80.

As shown in FIGS. 6A and 6B, the connecting rod 62*b* may have a generally elliptical cross sectional configuration. When the legs 58*c*, 58*d* are in the collapsed position as shown in FIG. 6A, the connecting rod 62*b* may be generally horizontally disposed within horizontal channel 78. Although a gap may be formed between the connecting rod 62*b* and the upper portion of the body 76, the inside corner 82 may hold the retainer 66 in a relatively stationary position relative to the connecting rod 62*b*. In this position, the flange 70 may be retained adjacent to or against the lower surface 16 of the table top 12. As the legs 58*c*, 58*d* are rotated to the extended position, the connecting rod 62*b* may rotate into the generally vertical channel 80 as shown in FIG. 6B. It will be appreciated that the connecting rod 62*b* does not have to rotate within the retainer 66 each time the connecting rod is rotated and the connecting rod could remain in a generally stationary position within the retainer, if desired. Thus, for example, the retainer 66 could rotate with the connecting rod 62*b* if desired.

The retainer 66 is preferably constructed from a deformable and generally resiliently material. As such, the retainer 66 may allow the connecting rod 62*b* to be moved between the generally horizontal and vertical positions. Preferably, the resilient material allows the connecting rod 62*b* to be moved into the desired position and then it returns to its original position to secure the connecting 62*b* in the desired position. It will be appreciated that the retainer 66 could be constructed from other materials with suitable characteristics.

The clip 72 of the retainer 66 is preferably sized and configured to receive a portion of the connecting rod 62*a* when the table top 12 is moved into the folded position to secure the table in the folded position. Desirably, the clip 72 selectively receives and retains the connecting rod 62*a* in a fixed position, such as by a snap fit, a friction fit, an interference fit or the like. For example, the clip 72 may include a pair of resiliently deformable arms 84*a*, 84*b* that project from the body 68 and are sized and configured to receive the connecting rod 62*a*. The arms 84*a*, 84*b* preferably include free ends and a gap may be disposed between the free ends. As the connecting rod 62*a* is inserted into the gap, the arms 84*a*, 84*b* may flex outwardly and then may resiliently fit around the connecting rod 62*a*, thereby selectively receiving and retaining the connecting rod 62*a*.

It will be appreciated that the retainer 66 can have other suitable shapes, configurations and designs. For example, the flange 70 can include one or more portions and these portions may have a variety of different sizes, shapes and configurations. It will also be appreciated that the opening 76 of the body 68 can have a variety of different configurations depending, for example, upon the size and configuration of the portion of the table 10 that the retainer 66 is attached. Further, it will be appreciated that the arms 84*a*, 84*b* may have other configurations depending, for example, upon the size and configuration of the portion of the table 10 that the retainer 66 is to be attached.

Figure 7B:
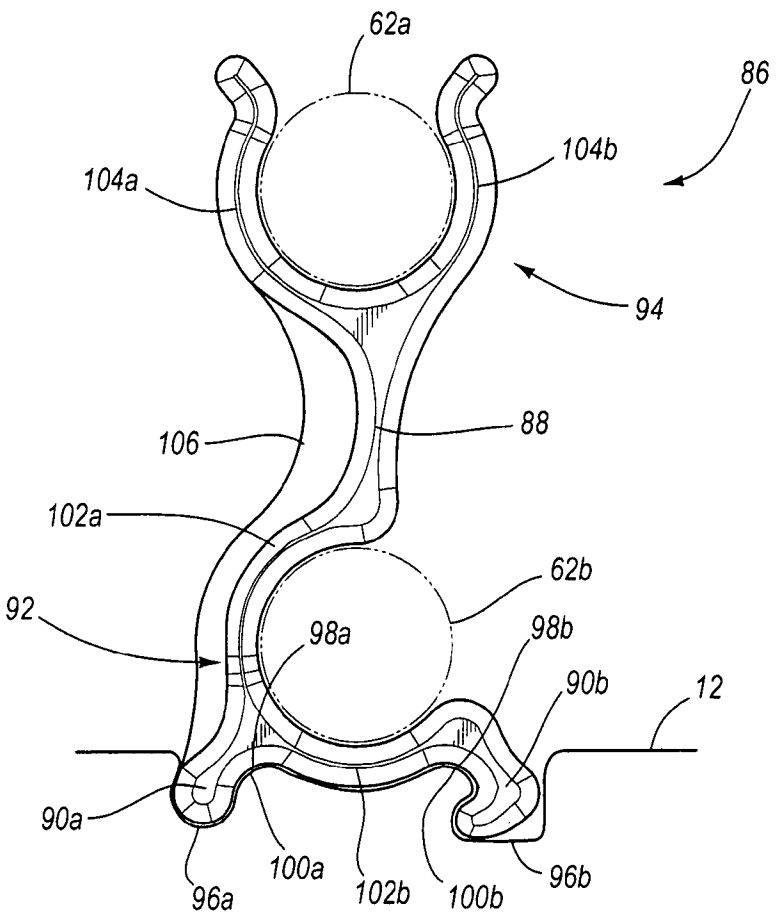
FIG. 7B is a side view of the retainer shown in FIG. 7A, illustrating the retainer connected to cross members.
Figure 7A:
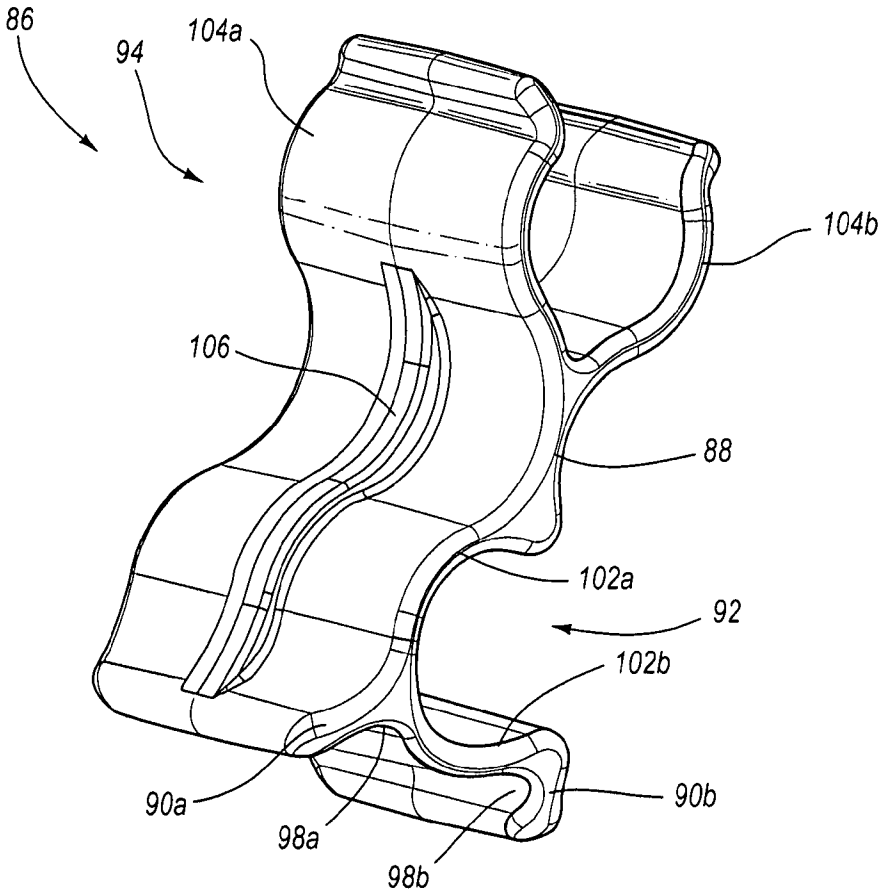
FIG. 7A is a perspective view of another exemplary retainer that may be used in connection with a table as shown in FIG. 1.

Another exemplary embodiment of a retainer that may be used in connection with the table 10 is shown in FIGS. 7A and 7B. The retainer 86 is preferably connected to portions of the table 10 to secure the table top 12 in the folded position. In particular, a first portion of the retainer 86 may be connected to a portion of the frame 42, such as one of connecting rods 62, and a second portion of the retainer may be connected to another portion of the frame, such as another connecting rod, to secure the table top 12 in the folded position. Preferably, the first portion of the retainer 86 is connected to the connecting rod 62*b* and the second portion of the retainer is connected to the connecting rod 62*a*, but it will be appreciated that the retainer could be connected to any suitable portions of the table.

In greater detail, as shown in the accompanying figures, the retainer 86 may include a body 88 with one or more flanges 90, a first clip 92 that is sized and configured to be connected to the connecting rod 62*b* and a second clip 94 that is sized and configured to be connected to the connecting rod 62*a*. As shown in the accompanying figures, the retainer 86 may include two flanges 90*a*, 90*b* that may be sized and configured to be disposed adjacent to or against the lower surface 16 of the table top 12 when the retainer is connected to the connecting rod 62*b*. The flanges 90*a*, 90*b* may also be sized and configured to prevent the retainer 86 from undesirably rotating. For example, as shown in FIG. 7B, the table top 12 may include one or more channels or receiving portions 96*a*, 96*b* that sized and configured to receive and/or retain all or a portion of the flanges 90*a*, 90*b*. The table top 12 may also include one or more engaging projections 100*a*, 100*b* that are sized and configured to be inserted into recessed portions 98*a*, 98*b* of the retainer 86. Advantageously, the flanges 90*a*, 90*b*; receiving portions 96*a*, 96*b*; recessed portions 98*a*, 98*b*; and projections 100*a*, 100*b* may be sized and configured to securely maintain the retainer 86 in a fixed position. In addition, these portions may allow the retainer 86 to be attached to the table top 12 using a snap fit, a friction fit, an interference fit or the like. Significantly, this may allow the retainer 86 to be quickly and easily connected to the table top 12. It will be appreciated that while the receiving portions 96*a*, 96*b* and/or the projections 100*a*, 100*b* may be formed integrally as part of a unitary, one-piece table top 12, the recesses and projections may be formed in any suitable fashion using any suitable process. It will also be appreciated, however, that the retainer 86 may be connected to the table top 12 in any suitable manner and the retainer does not have to be connected to the table top.

As shown in FIG. 7B, the connecting rods 62*b* is preferably disposed within the clip 92 and the connecting rod 62*a* is preferably disposed within the clip 94 when the folding table 10 is in the folded position. As shown in the accompanying figures, the connecting rods 62*a*, 62*b* may have a generally circular cross sectional configuration, but the connecting rods could have other suitable configurations. In greater detail, the clip 92 may include one or more resiliently deformable arms 102*a*, 102*b* that project from the body 88. The arms 102*a*, 102*b* preferably include free ends that are separated by an opening or gap. As the connecting rod 62*b* is inserted into the gap, the free ends of the arms 102*a*, 102*b* may deflect outwardly to allow the connecting rod to be inserted into the clip 92. The arms 102*a*, 102*b* may then resiliently return to their original configuration to receive and retain the connecting rod 62*b* within the clip 92. It will be appreciated that the connecting rod 62*b* may be connected to the clip 92 using other suitable types of connections.

When the table top 12 is moved into the folded position, the connecting rod 62*a* is preferably received and retained in the clip 94 by a snap fit, a friction fit, an interference fit or the like. For example, the clip 94 may include resiliently deformable rounded arms 104*a*, 104*b* that project from the body 88. The arms 104*a*, 104*b* preferably include free ends that are separated by an opening or gap. As the connecting rod 62*a* is inserted into the gap, the free ends of the arms 104*a*, 104*b* may deflect outwardly to allow the connecting rod to be inserted into the clip 94. The arms 104*a*, 104*b* may then resiliently return to their original configuration to receive and retain the connecting rod 62*a* within the clip 94. It will be appreciated that the connecting rod 62*a* may be connected to the clip 94 using other suitable types of connections.

As shown in FIGS. 7A and 7B, the retainer 86 may include a rib 106 that is disposed along at least a portion of the body 88 of the retainer. The rib 106 is preferably sized and configured to strengthen the retainer 86 and/or to help prevent the retainer from buckling under excessive pressure. Accordingly, the rib 106 may help provide a more durable retainer 86. As shown in the figures, the rib 106 may have a thicker middle portion that tapers towards the ends of the rib, but the rib may have a variety of other suitable configurations.

As mentioned above, the arms 102*a*, 102*b* preferably include free ends that are separated by a gap or opening that are sized and configured to receive and retain the connecting rod 62*b*. The arms 104*a*, 104*b* also preferably include free ends that are separated by a gap or opening that are sized and configured to receive and retain the connection rod 62*a*. Preferably, the connecting rod 62*b* is more securely attached to the retainer 86 than the connecting rod 62*a* so that when the table top 12 is moved to the unfolded position, the connecting rod 62*a* is released from the clip 94. It will be appreciated, however, that the connecting rods 62*a*, 62*b* may be selectively and/or securely attached to the clips 92, 94, as desired.

As best seen in FIG. 7B, the opening between the arms 102*a*, 102*b* is preferably offset from the opening between the arms 104*a*, 104*b*. In this offset configuration, at least one of the arms 102*a*, 102*b* may be sized and configured to help secure the retainer 86 in a generally fixed relationship relative to the table top 12 and/or secure the connecting rod 62*b* within the clip 92 when the table top 12 is moved between the folded and unfolded positions. Thus, when the table top 12 is moved from the folded position to the unfolded position, the connecting rod 62*a* is preferably removed from the clip 94 and the arm 102*b* may help resist movement of the retainer 86 by engaging at least a portion of the table top 12 (as discussed above) and/or by engaging at least a portion of the table frame (such as the connecting rod 62*b*). Thus, the arm 102*b* helps to help secure the retainer 86 in a generally fixed relationship relative to the table top 12 and/or the connecting rod 62*b*.

Figure 8B:
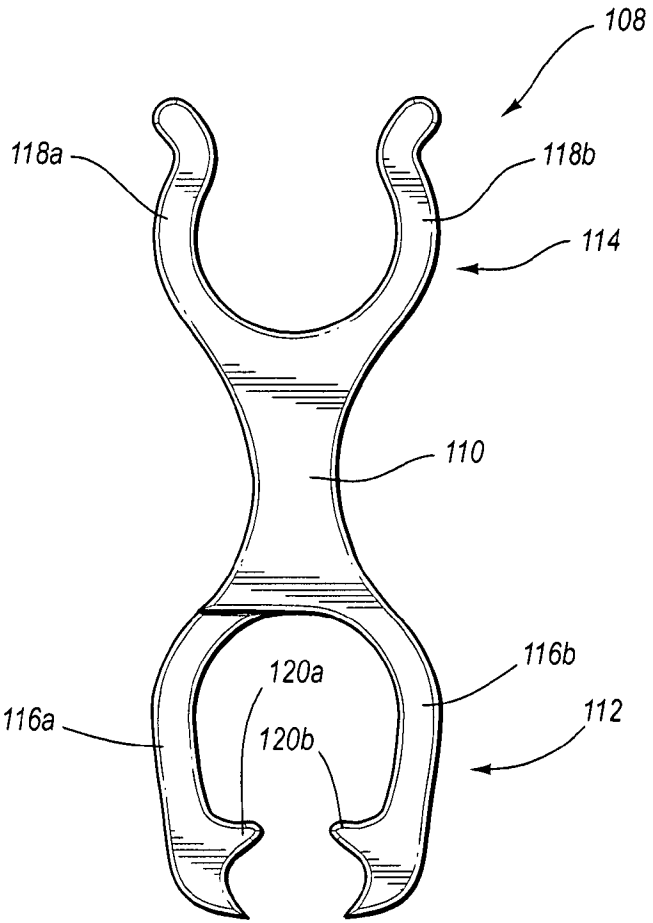
FIG. 8B is a side view of the retainer shown in FIG. 8A.
Figure 8A:
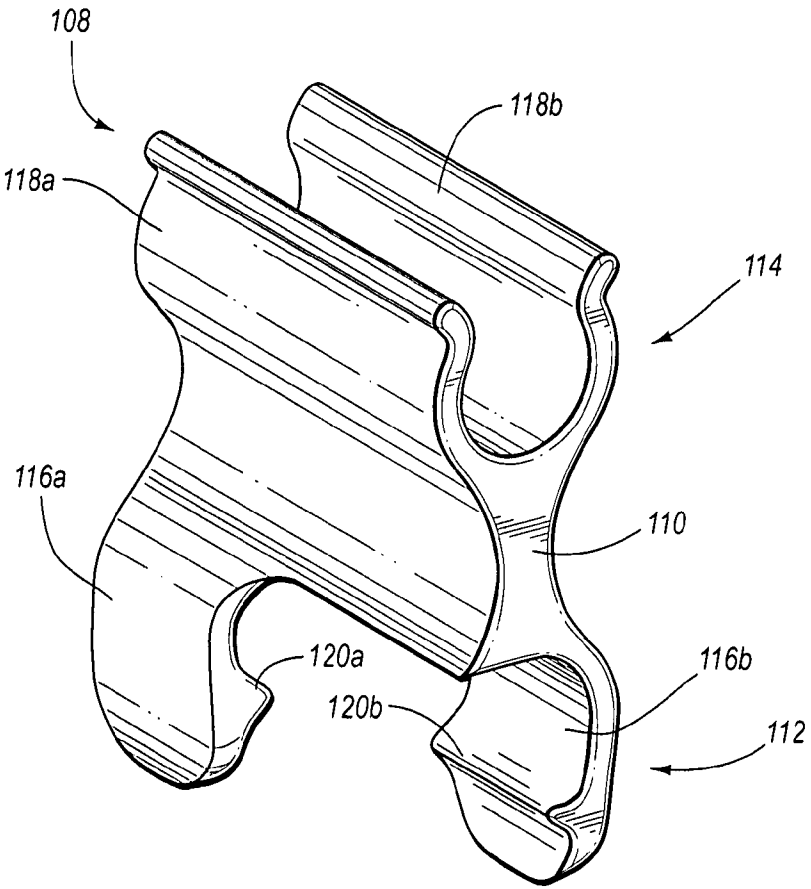
FIG. 8A is a perspective view of still another exemplary retainer that may be used in connection with a table as shown in FIG. 1.

Still another exemplary embodiment of a retainer that may be used in connection with the table 10 is shown in FIGS. 8A and 8B. The retainer 108 may include a body 110 with a first clip 112 and a second clip 114. Similar to the retainers 66 and 86 discussed above, the retainer 108 may be used to secure the table top 12 in the folded position. For example, the first clip 112 may be sized and configured to be connected to a first portion of the table top 12, such as the first table top section 32*a*, and the second clip 114 may be connected to a second portion of the table top, such as the second table top section 32*b*. In particular, the first clip 112 may be connected to a portion of the frame 42, such as the connecting rod 62*b*, and the second clip 114 may be connected to another portion of the frame 42, such as the connecting rod 62*a*. The retainer 108 is preferably sized and configured to selectively retain the table top 102 in the folded position.

In greater detail, the clip 112 may include resiliently deformable arms 116*a*, 116*b* that project from the body 110. The arms 116*a*, 116*b* preferably include free ends that are separated by a gap or opening. As the connecting rod 62*b* is inserted into the opening between the free ends of the arms 116*a*, 116*b*, the arms may deflect outwardly and then may resiliently return to receive and retain the connecting rod. The connecting rod 62*b* may also be disposed between the arms 116, 116*b* and then the retainer 108 may be turned or twisted so that the connecting rod engages or contacts the arms. The arms 116*a*, 116*b* may include ends that are disposed within receiving portions in the table top 12 to help prevent the retainer 108 for inadvertently moving.

When the table top 12 is moved into the folded position, the connecting rod 62*a* may be received and retained in the clip 114 by a snap fit, a friction fit, an interference fit or the like. For example, the clip 114 may include resiliently deformable rounded arms 118*a*, 118*b* that project from the body 110. The arms 118*a*, 118*b* preferably include free ends that are separated by an opening or a gap. As the connecting rod 62*a* is inserted into the opening between the free ends of the arms 118*a*, 118*b*, the arms may deflect outwardly and then may resiliently return to receive and retain the fit around the connecting rod. As best seen in FIG. 8B, the arms 116*a*, 116*b* and the arms 118*a*, 118*b* may be aligned.

The clip 112 is preferably securely attached to the connecting rod 62*b* and the table top 12 when the table top 12 is moved between the folded and unfolded positions. The clip 114, however, is preferably selectively secured to the connecting rod 62*a* to allow the table top 12 to be moved between the folded and unfolded positions. For example, when the table top 12 is moved from the folded position to the unfolded position, the connecting rod 62*a* is preferably removed from the clip 114. It will be appreciated that the clip 112 may have other suitable configurations and designs depending, for example, upon the configuration of the table top 12 and/or the intended use of the table 10.

As discussed above, various types of retainers may be used to secure the table top 12 in the folded position. In particular, the exemplary retainers 66, 86 and 108 may be used to secure the table top 12 in the folded position. Additionally, one end of the retainer may be securely connected to a portion of the table top, such as a connecting rod 62*b* of the frame 42, and the other end of the retainer may be selectively connection to another portion of the table top, such as the connection rod 62*a* of the frame. These exemplary retainers 66, 86 and 108 may have various suitable configurations and may include clips, such as clips 72, 92, 94, 112 and 114, and may include one or more arms, such as arms 84, 102, 104, 116 and 118. These clips and/or arms may be sized and configured to allow the retainers 66, 86 and 108 to be selectively and/or generally permanently attached to the table 10. These clips and/or arms may also have various sizes and configurations. For example, the arms may generally form all or just a portion of the clips and/or body of the retainers 66, 86 and 108. In addition, the clips and/or arms may be generally symmetrical or nonsymmetrical. For example, one arm may be longer than another arm or have a different shape. It will be appreciated that the retainers 66, 86 and 108, and portions of the retainers such as the bodies, arms and/or clips, may have other suitable shapes, sizes, arrangements and/or configurations.

The retainers 66, 86 and 108 are preferably constructed of any suitable material which provides sufficient strength and resilience including, but not limited to, plastic (such as acetal plastic). The retainers 66, 86 and 108 could also be constructed from other suitable materials such as metal. In addition, the retainers 66, 86 and 108 may be constructed using various suitable processes, such as extrusion molded plastic, rotation molded plastic, blow molded plastic, injection molded plastic and the like. It will be appreciated that the retainers 66, 86 and 108 may also be constructed using one or more materials and/or processes.

It is appreciated that the table 10 may include more than one retainer 66, 86 or 108. For example, multiple retainers 66, 86, 108 may be used to secure the table top 12 in the folded position. In addition, multiple types of retainers may be used, if desired. Advantageously, the retainers 66, 86, 108 may allow the folded table 10 to be more easily carried, transported and stored without unintentional unfolding. In addition, the retainers 66, 86, 108 may be connected to the table 10 without the requirement of mechanical fasteners, but mechanical fasteners may be used if desired. Further, while the retainers 66, 86, 106 may be useful, the table 10 does not require the retainers.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top including a first portion that is movable relative to a second portion between a folded position and an unfolded position;

a first leg movable between an extended position and a collapsed position relative to the table top;

a second leg movable between the extended position and the collapsed position relative to the table top;

a first support member connected to the first portion of the table top;

a second support member connected to the second portion of the table top; and a retainer including a first portion connected to the first support member and a second portion connected to the second support member when the table top is in the folded position, the retainer being sized and configured to selectively secure the table top in the folded position, the first portion of the retainer including an opening that receives the first support member when the table top is in the folded position, the first portion of the retainer including a body that at least partially defines the opening and that retains the first support member in a generally fixed position by at least partially surrounding a section of the first support member when the table top is in the folded position, the first portion of the retainer including a first outwardly extending flange that contacts and abuts the first portion of the table top to help prevent the retainer from inadvertently moving relative to the first portion of the table top, the second portion of the retainer including an opening that retains the second support member in a generally fixed position when the table top is in the folded position.

2. The table as in claim 1, wherein the first leg is connected to the first support member and the second leg is connected to the second support member.

3. The table as in claim 1, wherein the opening in the first portion of the retainer is disposed in a first direction and the opening in the second portion of the retainer is disposed in a second direction, the first direction being different from the second direction.

4. The table as in claim 1, wherein the opening in the first portion of the retainer has a generally non-circular cross section.

5. The table as in claim 1, wherein the first portion of the retainer includes a second outwardly extending flange that contacts and abuts the first portion of the table top to help prevent the retainer from inadvertently moving relative to the first portion of the table top.

6. The table as in claim 1, further comprising a first arm and a second arm that at least partially define the opening in the second portion of the retainer, the first arm and the second arm being spaced apart by a distance that is less than a width of the second support member.

7. The table as in claim 1, wherein the first outwardly extending flange engages the first portion of the table top to help prevent the retainer from inadvertently moving relative to the first portion of the table top during movement of the first and second legs between the extended and collapsed positions.

8. The table as in claim 1, wherein the first outwardly extending flange engages the first portion of the table top using a snap, friction and/or interference fit.

9. A table comprising:

a table top including a first section that is movable relative to a second section between a folded position and an unfolded position;

a first leg movable between an extended position and a collapsed position relative to the table top;

a second leg movable between the extended position and the collapsed position relative to the table top; and a retainer that is sized and configured to selectively secure the table top in the folded position, the retainer comprising:

a first portion including an opening that is sized and configured to receive a portion of the first section of the table top when the table top is in the folded position, the first portion of the retainer including a body that at least partially defines the opening and that retains the received portion of the first section of the table top in a generally fixed position by at least partially surrounding the received portion of the first section of the table top when the table top is in the folded position, the first portion of the retainer including an outwardly extending flange that contacts and abuts the first section of the table top to help prevent the retainer from inadvertently moving relative to the first section of the table top; and a second portion including an opening that is sized and configured to receive and retain a portion of the second section of the table top in a generally fixed position when the table top is in the folded position.

10. The table as in claim 9, further comprising a first support member connected to the first portion of the table top and a second support member connected to the second portion of the table top, the first portion of the retainer being connected to the first support member and the second portion of the retainer being connected to the second support member when the table top is in the folded position.

11. The table as in claim 9, wherein the first portion of the retainer includes resiliently deformable arms to facilitate the connection of the first portion of the retainer to the first section of the table top and the second portion of the retainer includes resiliently deformable arms to facilitate the connection of the second portion of the retainer to the second section of the table top.

12. The table as in claim 9, wherein the table includes a first cross member disposed proximate a first end of the table top and a second cross member disposed proximate a second end of the table top; and wherein the first portion of the retainer is connected to the first cross member and the second portion of the retainer is connected to the second cross member when the table top is in a folded position.

13. The table as in claim 9, wherein the outwardly extending flange of the retainer includes an outer surface that engages the first section of the table top.

14. The table as in claim 9, wherein the outwardly extending flange engages the first section of the table top to help prevent the retainer from inadvertently moving relative to the first section of the table top during movement of the first and second legs between the extended and collapsed positions.

15. A table comprising:

a table top including a first portion that is movable relative to a second portion between a folded position and an unfolded position;

a first leg movable between an extended position and a collapsed position relative to the table top;

a second leg movable between the extended position and the collapsed position relative to the table top;

a retainer that is sized and configured to selectively secure the table top in the folded position, the retainer comprising:

a first end including an opening that is sized and configured to receive a piece of the first portion of the table top when the table top is in the folded position, the first end of the retainer including a body that at least partially defines the opening and that retains the received piece of the first portion of the table top in a generally fixed position by at least partially surrounding the received piece of the first portion of the table top when the table top is in the folded position, the first end of the retainer including an outwardly extending flange that contacts and abuts the first portion of the table top to help prevent the retainer from inadvertently moving relative to the first portion of the table top; and a second end including an opening that is sized and configured to selectively receive and retain a piece of the second portion of the table top when the table top is in the folded position.

16. The table as in claim 15, further comprising a table frame including a first portion connected to the first portion of the table top and a second portion connected to the second portion of the table top, the first end of the retainer being connected to the first portion of the frame and the second end of the retainer being connected to the second portion of the frame when the table top is in the folded position.

17. The table as in claim 15, wherein the second end of the retainer includes resiliently deformable arms.

18. The table as in claim 15, wherein the table top includes one or more receiving portions and the retainer includes one or more projections that are sized and configured to be disposed in the receiving portions.

19. The table as in claim 15, wherein the table top includes one or more projections and the retainer includes one or more receiving portions that are sized and configured to receive the projections.

20. The table as in claim 15, wherein the outwardly extending flange engages the first portion of the table top to help prevent the retainer from inadvertently moving relative to the first portion of the table top during movement of the first and second legs between the extended and collapsed positions.

* * * * *

UNITED STATES PATENT AND TRADEMARK OFFICE

CERTIFICATE OF CORRECTION

PATENT NO. : 7,634,969 B2
APPLICATION NO. : 11/112075
DATED : December 22, 2009
INVENTOR(S) : Neunzert et al.

It is certified that error appears in the above-identified patent and that said Letters Patent is hereby corrected as shown below:

Title Page, should read (*) Notice: Subject to any disclaimers, the term of this patent is extended or adjusted under 35 U.S.C. 154(b) by 566 days.

Column 1
Line 58, change "table" to --tables--

Column 2
Line 56, change "there" to --there are--

Column 4
Line 21, change "gasp" to --grasp--

Column 5
Line 49, change "simply" to --simplify--

Column 6
Line 12, change "limits" to --limit--
Line 25, change "is" to --in--
Line 56, change "are" to --is--

Column 8
Line 37, change "part" to --apart--

Column 9
Line 30, change "table-top" to --table top--
Line 36, delete the "," after "to"
Line 42, change "may" to --may be--
Line 52, change "and outer" to --an outer--

Signed and Sealed this

Thirty-first Day of August, 2010

David J. Kappos

David J. Kappos
*Director of the United States Patent and Trademark Office*

Column 10
Line 11, change "portion" to --portions--
Line 53, delete "is"
Line 57, change "surface" to --surfaces--

Column 11
Line 34, change "be" to --by--
Line 51, change "342*b*" to --32*b*--

Column 12
Line 2, change "32 to" to --32*b* to--
Line 10, change "gasp" to --grasp--
Line 54, change "table top 10" to --table 10--

Column 14
Line 53, change "then" to --than--

Column 15
Line 17, change "resiliently" to --resilient--
Line 22, change "connecting" to --connecting rod--

Column 16
Line 12, change "that" to --that are--

Column 17
Line 49, change "102" to --12--
Line 58, change "116, 116*b*" to --116*a*, 116*b*--
Line 62, change "for" to --from--

Column 18
Line 26, change "connection" to --connected--

UNITED STATES PATENT AND TRADEMARK OFFICE

CERTIFICATE OF CORRECTION

PATENT NO. : 7,634,969 B2
APPLICATION NO. : 11/112075
DATED : December 22, 2009
INVENTOR(S) : Neunzert et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 566 days.

Signed and Sealed this

Twenty-third Day of November, 2010

David J. Kappos

David J. Kappos
*Director of the United States Patent and Trademark Office*